US006004714A

United States Patent [19]

Ciccarelli et al.

[11] Patent Number: 6,004,714

[45] Date of Patent: Dec. 21, 1999

[54] TONER COMPOSITIONS

[75] Inventors: Roger N. Ciccarelli, Rochester; Denise R. Bayley, Fairport; Thomas R. Pickering, Webster, all of N.Y.; Jacques C. Bertrand, Amherst, N.H.

[73] Assignee: Xerox Corporation, Stamford, Conn.

[21] Appl. No.: 09/132,188

[22] Filed: Aug. 11, 1998

[51] Int. Cl.[6] ..... G03G 9/097

[52] U.S. Cl. ..... 430/110; 430/137

[58] Field of Search ..... 430/110, 111, 430/137

[56] References Cited

U.S. PATENT DOCUMENTS

| | | | |
|---|---|---|---|
| 2,986,521 | 5/1961 | Wielicki | 252/62.1 |
| 3,590,000 | 6/1971 | Palermiti et al. | 252/62.1 |
| 3,893,935 | 7/1975 | Jadwin et al. | 252/62.1 |
| 3,900,588 | 8/1975 | Fisher | 427/19 |
| 3,944,493 | 3/1976 | Jadwin et al. | 252/62.1 P |
| 4,007,293 | 2/1977 | Mincer et al. | 427/19 |
| 4,079,014 | 3/1978 | Burness et al. | 252/62.1 P |
| 4,221,856 | 9/1980 | Lu | 430/110 |
| 4,291,111 | 9/1981 | Lu | 430/107 |
| 4,291,112 | 9/1981 | Lu | 430/110 |
| 4,298,672 | 11/1981 | Lu | 430/108 |
| 4,312,933 | 1/1982 | Lu | 430/122 |
| 4,338,390 | 7/1982 | Lu | 430/106 |
| 4,394,430 | 7/1983 | Jadwin et al. | 430/110 |
| 4,560,635 | 12/1985 | Hoffend et al. | 430/106.6 |
| 4,904,762 | 2/1990 | Chang et al. | 430/110 |
| 5,223,368 | 6/1993 | Ciccarelli et al. | 430/110 |
| 5,304,449 | 4/1994 | Hollenbaugh, Jr. | 430/110 |
| 5,843,525 | 12/1998 | Shibasaki et al. | 427/214 |
| 5,885,743 | 3/1999 | Takayanagi et al. | 430/110 |

*Primary Examiner*—John Goodrow
*Attorney, Agent, or Firm*—E. O. Palazzo

[57] ABSTRACT

A toner comprised of binder, colorant, and a silica containing a coating of an alkylsilane.

47 Claims, No Drawings

TONER COMPOSITIONS

COPENDING APPLICATIONS

Illustrated in copending applications U.S. Ser. No. 09/132,623 pending, filed concurrently herewith, the disclosure of which is totally incorporated herein by reference, is a toner comprised of resin, colorant and a coated silica, and wherein the silica has a primary particle size of about 25 nanometers to about 55 nanometers and an aggregate size of about 225 nanometers to about 400 nanometers and a coating comprised of a mixture of an alkylsilane, and an aminoalkylsilane; and U.S. Ser. No. 09/132,185 pending, filed concurrently herewith, the disclosure of which is totally incorporated herein by reference, is a toner with a coated silica with, for example, certain BET characteristics.

The appropriate components and processes of the copending applications may be selected for the present invention in embodiments thereof.

BACKGROUND OF THE INVENTION

The present invention is generally directed to toner and developer compositions, and more specifically, the present invention is directed to positively, or negatively charged toner compositions, or toner particles containing certain silica surface additives, and more specifically, silicas coated with an alkylsilane inclusive of polyalkylsilanes such as decylsilane, and which coated silicas are available from Cabot Corporation. With the toners of the present invention, in embodiments thereof a number of advantages are achievable, such as excellent triboelectric charging characteristics, substantial insensitivity to humidity, especially humidities of from about 20 to about 80 percent, superior toner flow through, stable triboelectric charging values, such as from about 10 to about 55 microcoulombs per gram as determined for example, by the known Faraday cage, and wherein the toners enable the generation of developed images with superior resolution, and excellent color intensity. The aforementioned toner compositions can contain colorants, such as dyes, pigments comprised of, for example, carbon black, magnetites, or mixtures thereof, cyan, magenta, yellow, blue, green, red, or brown components, or mixtures thereof, thereby providing for the development and generation of black and/or colored images, and enabling two component development and single component development wherein carrier or carrier particles are avoided.

The toner and developer compositions of the present invention can be selected for electrophotographic, especially xerographic, imaging and printing processes, including color and digital processes.

PRIOR ART

Toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, and which additives are generally each present in an amount of from about 1 percent by weight to about 5 percent by weight, and preferably in an amount of from about 1 percent by weight to about 3 percent by weight. Several of the aforementioned additives are illustrated in U.S. Pat. Nos. 3,590,000 and 3,900,588, the disclosures of which are totally incorporated herein by reference.

Also known are toners containing a mixture of hexamethyldisilazane (HMDZ) and aminopropyltriethoxysilane (APTES). Disadvantages associated with these toners may include in certain instances a low, relatively unstable triboelectic charge, and high relative humidity sensitivity, and disadvantages of toners containing as surface additives HMDZ include, for example, unstable tribo, relative humidity sensitivity, and low charge/wrong sign toner as measured by a charge spectrograph.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar teachings are presented in U.S. Patent No. 4,291,112 wherein A is an anion including, for example, sulfate, sulfonate, nitrate, borate, chlorate, and the halogens. There is described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive. Surface additives, such as the prior art silicas like AEROSILS, may be incorporated into the toners of these patents.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. These and other charge enhancing additives of the prior art, such as these illustrated in U.S. Pat. Nos. 5,304,449; 4,904,762, and 5,223,368, the disclosures of which are totally incorporated herein by reference, may be selected for the present invention in embodiments thereof.

SUMMARY OF THE INVENTION

Examples of features of the present invention in embodiments thereof include:

It is a feature of the present invention to provide toner and developer compositions with certain surface additives, such as a coated alkylsilane and wherein the toners possess a number of advantages, as indicated herein.

Additionally, in another feature of the present invention there are provided negatively charged toner compositions useful for the development of electrostatic latent images including color images.

A further feature of the present invention is to provide certain surface additives that enable toners with fast admix as measured by a charge spectrograph.

In yet another feature of the present invention there are provided certain surface additives that enable unimodal toner charge distribution as measured by a charge spectrograph.

Also, in another feature of the present invention there are provided certain surface additives that enable substantially no wrong sign positive charged toner and very little low or minimum charged negative toner as measured by a charge spectrograph.

Another feature of the present invention resides in the provision of toner and developer compositions with a certain surface additive that enable acceptable high stable triboelectric charging characteristics of from about 15 to about 55 microcoulombs per gram, and preferably from about 25 to about 40 microcoulombs per gram.

Other features of the present invention include the provision of toner and developer compositions with surface additives and wherein there is enabled toners with humidity insensitivity, from about, for example, 20 to 80 percent relative humidity at temperatures of from about 60 to about 80° F. as determined in a relative humidity testing chamber; negatively charged toner compositions with desirable admix properties of 1 second to about 60 seconds as determined by the charge spectrograph, and more preferably less than about 30 seconds; toner compositions that fuse at low temperatures, for example, below about 350° F. resulting in high quality black and or color images; and the development of images in electrophotographic imaging apparatuses, which images have substantially no background deposits thereon, are substantially smudge proof or smudge resistant, and therefore are of excellent resolution, and further, wherein such toner compositions can be selected for high speed electrophotographic apparatuses, that is those exceeding about 60 copies per minute.

Aspects of the present invention are a toner comprised of binder, colorant, and a silica containing a coating of an alkylsilane, preferably an alkylsilane, such as a polyalkylsilane, which silane is present in a suitable amount of for example about 3 to about 10 weight percent, from about 4 to about 10 weight or from about 6 to about 8 weight percent; wherein the coated silica possesses a primary particle size of from about 25 to about 55 nanometers, and an aggregate size of from about 225 to about 400 nanometers; wherein the alkyl of the silane contains from about 1 to about 25 carbon atoms; wherein the alkylsilane is decylsilane; wherein the alkylsilane is an alkylsilane polymer such as a decylsilane polymer and the like; wherein the amount of the alkylsilane on the toner surface is determined from the feed rate or feed amount of an alkylalkoxysilane which amount is from about 5 to about 25 weight percent; wherein the alkylalkoxysilane feed amount is from about 5 to about 15 weight percent; wherein the toner further includes metal salts of fatty acids such as zinc stearate; wherein the toner further includes a wax; wherein the toner resin is polyester; wherein the toner resin is a polyester formed by condensation of propoxylated bisphenol A and fumaric acid; wherein the toner resin is comprised of a mixture of a polyester formed by condensation of propoxylated bisphenol A and a dicarboxylic acid, and a gelled polyester formed by condensation of propoxylated bisphenol A and fumaric acid; wherein the colorant particles are carbon black, cyan, magenta, yellow, red, orange, green, or violet; wherein the silica is coated with an alkylsilane wherein the alkyl chain length is for example from about 4 to about 18, and wherein alkyl is butyl, hexyl, octyl, decyl, dodecyl, or stearyl and alkoxy contains from 1 to about 10 carbons; wherein the silica is coated with decylsilane; wherein the toner further contains a titanium oxide optionally coated with an alkylsilane inclusive of an alkylsilane polymer; wherein the silica is coated with an input feed mixture containing about 10 to about 25, and preferably about 15 weight percent of an alkylalkoxysilane like decyltrialkoxysilane; wherein the silica has a primary particle size of about 25 nanometers. to about 55 nanometers; and/or wherein the silica has a primary particle size of about 30 nanometers. to about 40 nanometers; wherein the silica has an aggregate size of about 225 nanometers to about 400 nanometers, or has an aggregate size of about 300 nanometers to about 375 nanometers; wherein the titania or titanium dioxide has a primary particle size of about 25 nanometers to about 55 nanometers; wherein the coated silica is present in an amount of from about 1 weight percent to about 6 weight percent; wherein the coated silica is present in an amount of from about 2.75 weight percent to 4.75 weight percent; wherein the titania is present in an amount from about 1 weight percent to 4.5 weight percent, or is present in an amount from about 1.5 weight percent to 3.5 weight percent; wherein the metal salt is zinc stearate and is present in an amount from about 0.10 weight percent to 0.60 weight percent; wherein the toner possesses a triboelectric charge of from about 15 to about 55 microcoulombs per gram, or from about 25 to about 40 microcoulombs per gram; wherein the toner resin is present in an amount of from about 85 weight percent to about 99 weight percent and the colorant is present in an amount from about 15 weight percent to about 1 weight percent; wherein the toner possesses an admix time of less than about 30 seconds, or an admix time of from about 1 second to about 60 seconds; a developer comprised of toner and carrier; a toner with an unimodal charge distribution as measured by a charge spectrograph; a toner with an unimodal charge distribution and none or very little low charge or wrong sign toner as measured by a charge spectrograph; and a toner composition comprised of a binder, such as resin particles like a polyester resin, colorant, and surface additives comprised of a mixture of metal oxides, like titanium oxides, and certain conductivity aides such as metal salts of fatty acids, like zinc stearate, and optional additives such as charge additives, and a surface additive comprised of silica coated with an alkylsilane such as a polyalkylsilane; a toner comprised of binder, colorant, and a silica containing a coating of an alkylsilane; a toner wherein said alkylsilane is an alkylsilane polymer present in an amount from about 3 to about 10 weight percent, and wherein said coated silica possesses a primary particle size of from about 25 to about 55 nanometers, and an aggregate size of from about 225 to about 400 nanometers; and a toner wherein the alkylsilane is of the formula

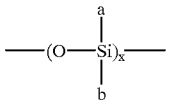

wherein a represents the repeating segment of

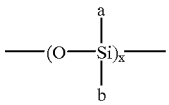

optionally enabling a crosslinked formula or structure; said repeat segment and hydroxy or hydroxy groups; said repeat segment and alkoxy or alkoxy groups; or said repeat segment and hydroxy and alkoxy groups; b is alkyl with, for example, from 1 to about 25, and more specifically, from about 5 to about 18 carbon atoms; and x is a number of from 1 to about 1,000, and more specifically, from about 25 to about 500. The coated silica preferably possess a primary particle size as measured by BET, named for Brunauer, Emmett, and Teller, and which BET is a standard known technical method that measures surface area, and with model assumptions there can be calculated, for example, the primary particle size of, for example, from about 20 nanometers to about 400 nanometers and preferably from about 25 nanometers to about 55 nanometers.

The alkylsilane coating can be generated from an alkylalkoxysilane as illustrated herein, and more specifically from a reaction mixture of a silica like silicon dioxide core and an alkylalkoxysilane, such as decyltrimethoxysilane. There results from the reaction mixture the alkylsilane coating contained on the silica core, and which coating is preferably a crosslinked polymer which includes the alkylsilane, like decylsilane, residual alkoxy groups, and/or hydroxy groups. Preferably in embodiments the alkylsilane coating is a polymeric coating that contains crosslinking and which coating may, it is believed, be represented by the formula

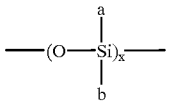

wherein a represents a repeat segment, that is a is, for example,

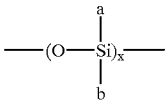

and which a can be repeated a number of times, and thereby optionally enables a crosslinked formula or structure; a repeat segment and hydroxy or hydroxy groups; a repeat segment and alkoxy or alkoxy groups; a repeat segment and hydroxy and alkoxy groups; b is alkyl with, for example, from 1 to about 25, and more specifically, from about 5 to about 18 carbon atoms; and x is a suitable number of, for example, from 1 to about 1,000, and more specifically, from about 25 to about 500. The titanium dioxide surface additive is of a similar formula or structure illustrated with regard to the alkylsilane except that the Si is replaced with Ti.

Based on the weight of silica, the amount of silane, such as decyltrimethoxysilane, used to coat the silica is determined or calculated from, for example, the feed rate of the alkoxysilane, which feed rate is, for example, from about 5 weight percent to about 25 weight percent. For example, 100 grams of silica can be mixed and reacted with from about 5 grams to about 25 grams (about 5 weight percent to about 25 weight percent) of decyltrimethoxysilane. The silica is reacted by heating with the decyltrimethoxysilane in a suitable manner to form a coating having a coating weight, for example, of less than or equal to about 10 weight percent, such as from about 3 to about 10 weight percent on the silica surface. These coated silica particles can then be blended on the toner surface in an amount of for example from about 0.50 weight percent to 10 weight percent, and preferably from about 4 percent to about 6 weight percent. The toner may also include further optional surface additives such as certain uncoated or coated titania or titanium dioxide particles present in an amount, for example, of from about 0.50 weight percent to 10 weight percent, and preferably from about 1.5 to about 4 weight percent of titania which can be coated with an alkylsilane such as a decylsilane. Based on the weight of titania, the amount of decyltrimethoxysilane used to coat the titania is from about 5 weight percent to about 15 weight percent. For example, 100 grams of titanium dioxide can be mixed with from about 5 grams to about 15 grams (about 5 weight percent to about 15 weight percent) of decyltrimethoxysilane, or similar suitable silane. In addition, the toner may also include additional surface additives such as a conductivity aide like zinc stearate in an amount of, for example, from about 0.05 weight percent to about 0.60 weight percent.

The toner compositions of the present invention can be prepared by admixing and heating resin particles such as styrene polymers, polyesters, and similar thermoplastic resins, colorant, optional wax, especially low molecular weight waxes, with an $M_w$ of, for example, from about 1,000 to about 20,000, and optional charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of for example less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the coated alkylsilane silica and other additives can be added by the blending thereof with the toner obtained.

Illustrative examples of suitable binders, include toner resins, especially thermoplastic resins, like styrene methacrylate, polyolefins, styrene acrylates, such as PSB-2700 obtained from Hercules-Sanyo Inc., polyesters, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of styrene polymers, may be selected.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking as illustrated in U.S. Pat. No. 5,352,556, the disclosure of which is totally incorporated herein by reference, styrene acrylates, and mixtures thereof. Also, waxes with a molecular weight $M_w$, of from about 1,000 to about 20,000, such as polyethylene, polypropylene, and paraffin waxes, can be included in, or on the toner compositions as fuser roll release agents. The resin is present in a sufficient, but effective amount, for example from about 50 to about 95 or from about 70 to about 90 weight percent.

Colorant includes pigment, dyes, mixtures thereof, mixtures of dyes, mixtures of pigments and the like. Examples of colorants present in suitable amounts such as from about 1 to about 20 and preferably from about 2 to about 10 weight percent, are carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTATA™ available from E.I. DuPont de Nemours & Company, and the like. Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL, and known suitable dyes, such as red, blue, green, and the like.

Magnetites selected include a mixture of iron oxides ($FeO.Fe_2O_3$), including those commercially available as MAPICO BLACK™, and are present in the toner composition in various effective amounts, such as an amount of from about 10 percent by weight to about 75 percent by weight, and preferably in an amount of from about 30 percent by weight to about 55 percent by weight.

There can be included in the toner compositions of the present invention charge additives as indicated herein in various effective amounts, such as from about 1 to about 15, and preferably from about 1 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected possess, for example, a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 1 percent by weight to about 15 percent by weight, and preferably in an amount of from about 2 percent by weight to about 10 percent by weight. The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, and for example from about 2 percent toner concentration to about 8 percent toner concentration. The carriers can include coatings thereon, such as those illustrated in the 4,937,166 and 4,935,326 patents, and other known coatings. There can be selected a single coating polymer, or a mixture of polymers. Additionally, the polymer coating, or coatings may contain conductive components therein, such as carbon black in an amount for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present invention, reference for example a number of the patents mentioned herein, and U.S. Pat. Nos. 4,585,884, 4,584,253, 4,563,408, and 4,265,990, the disclosures of which are totally incorporated herein by reference.

The following Examples are being submitted to further illustrate various aspects of the present invention. These Examples are intended to be illustrative only and are not intended to limit the scope of the present invention. Comparative Examples and data are also provided.

EXAMPLE I

Preparation of Coated Silica

200 Milliliters of dry n-propanol solvent were placed in a three neck 500 milliliter round bottom flask. The solvent was sparged or purged with dry nitrogen to remove excess oxygen. One 10 milliliters aliquot of solvent were removed to a small 2 dram vial and set aside. A second 20 milliliters aliquot were also removed and placed in a scintillation vial. 15 Grams of untreated hydrophilic $SiO_2$ silica TL90 available from Cab-O-Sil Corp. with a primary size of 30 nanometers as measured by BET and an aggregate size of about 300 nanometers as measured by Brownian Motion were added to the flask and mixed with a mechanical mixer until wetted. An inert atmosphere was maintained during this mixing. A few drops of diethylamine were added to the 10 milliliters aliquot of solvent and the resulting mixture was added to the 500 milliliters flask. The mixture was then stirred for approximately 1 hour. To the 20 milliliters of solvent in the scintillation vial were added 2.25 grams of decyltrimethoxysilane. This was added to the 500 milliliters flask containing the $SiO_2$ after the 1 hour of pretreatment was completed. A heating mantle was attached, and the mixture was heated to reflux with stirring and under an inert atmosphere. Heat was applied for approximately 5 hours and then was turned off and the mixture was allowed to cool down to room temperature, about 25° C., throughout. The resulting mixture was then transferred to a tear shaped flask and the flask was then attached to a rotovapor evaporator and the solvent stripped off with heat and vacuum. The flask was transferred to a vacuum oven and drying was completed over night, about 18 hours throughout under full vacuum and a moderate temperature of 40° C. The resulting decylsilane polymer coated silica was crushed with a mortar and pestle, and had a primary particle size of 30 nanometers as measured by BET and an aggregate size of about 300 nanometers as measured by Brownian Motion.

EXAMPLE II

Preparation of Coated Silica

Thirty (30) grams of an untreated hydrophilic $SiO_2$ silica powder with a primary particle size of about 40 nanometers and an aggregate size of about 300 nanometers were placed in a Buechi 2 liter autoclave reactor, and the reactor was sealed. An inert gas, argon, was then purged for 30 minutes through the reactor to remove atmospheric gases. The reactor was then evacuated of atmospheric gases using a vacuum pump and warmed to 28° C., the vacuum valve was then closed and an ampoule of triethylamine was connected to the reactor such that the vapor space of the ampoule and the upper portion of the reactor were connected, thereby allowing the vapor phase transport of triethylamine to the bed of silica for 15 minutes. The valve from the ampoule to the reactor was then closed and the valve to the vacuum reopened to remove the triethylamine that was not physisorbed to the surface of silica. The reactor was then cooled to 0° C. with the aide of a Laude circulating bath connected to the reactor jacket. After achieving a temperature of 0° C., 570 grams of carbon dioxide (bone-dry grade obtained from Praxair) were then added to the chilled reactor with the assistance of an ISCO Model 260D motorized syringe pump. Agitation of the reactor was then initiated at 10 rpm. 4.5 Grams of decyltrimethoxysilane from Shin-Etsu Silicones were then dissolved in a separate variable volume pressure cell using carbon dioxide as the solvent. The pressure in the cell was 100 bar which is sufficient to generate a homogeneous solution of silane in carbon dioxide. The decyltrimethoxysilane solution was then injected into the Buechi 2 liter reactor. The temperature of the reactor was maintained at 0° C. and agitated at 100 rpm for 30 minutes, and the agitation was then stopped, and the carbon dioxide was vented off from the upper portion of the reactor, the vapor space. Subsequent to the aforementioned depressurization, the reactor temperature was increased to 28 to 30° C. After equilibration at this temperature, the resulting decylsilane polymer coated silica product was removed for overnight vacuum treatment (about 18 hours) and then spectroscopically characterized via infrared spectroscopy.

EXAMPLE III

A toner resin was prepared by the polycondensation reaction of bisphenol A and fumaric acid to form a linear polyester referred to as Resapol HT.

A second polyester was prepared by selecting Resapol HT and adding it to an extruder with a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, and more specifically, the polyester of the '494 patent, the disclosures of each of these patents being totally incorporated herein by reference.

EXAMPLE IV

75 Parts by weight of the resin Resapol HT from Example III, 14 parts by weight of the 30 weight percent gel polyester from Example III, and 11.0 parts by weight of Sun Blue Flush, which is a mixture of 30 weight percent P.B.15:3 copper phthalocyanine and 70 weight percent Resapol HT prepared at Sun Chemicals by flushing to obtain a high quality pigment dispersion, were blended together and extruded in a ZSK-40 extruder. The extruded blend was jetted and classified to form a cyan toner with about 8 weight percent of 15:3 copper phthalocyanine with a toner particle size of about 6.5 microns as measured by a Layson Cell. The final cyan toner had a gel concentration of 5 weight percent.

COMPARATIVE EXAMPLE V

A thirty (30) gram sample of the toner from Example IV was added to a 9 ounce jar with 150 grams of stainless steel beads. To this was added 0.6 weight percent TS530 (15 nanometers of primary particle size fumed silica coated with hexamethyidisilazane and which coated silica is available from Cab-O-Sil Division of Cabot Corp.), 0.9 weight percent TD3103 (15 nanometers of primary particle size titanium dioxide coated with decylsilane generated from decyltrimethoxysilane obtained from Tayca Corp.), and 0.3 weight percent zinc stearate L obtained from Synthetic Products Company. After mixing on a roll mill for 30 minutes, the steel beads were removed from the jar.

A developer was prepared by mixing 4 parts of the above prepared blended toner with 100 parts of a carrier of a Hoeganaes steel core coated with 80 weight percent of polymethylmethacrylate and 20 weight percent of a conductive carbon black. Testing of this developer in, for example, a Xerox Corporation 5090 breadboard resulted in poor image quality due primarily to a loss in developability of the toner caused by, for example, the coated silica, the small size 15 nanometers TS530 silica and/or small size 15 nanometers of TD3103 titanium dioxide.

COMPARATIVE EXAMPLE VI

A toner blend was prepared as in Example V except 4.2 weight percent RX50 (40 nanometers of primary particle size and about 300 nanometers of aggregate size fumed silica coated with hexamethyidisilazane from Nippon Aerosil Corp.), 2.5 weight percent SMT5103 (30 nanometers of primary particle size titanium dioxide coated with decylsilane from Tayea Corp.), and 0.3 weight percent zinc stearate L from Synthetic Products Company were blended onto the toner surface. After mixing on a roll mill for 30 minutes, the steel beads are removed from the jar. A developer was then prepared by mixing 4 parts of the blended toner with 100 parts of a carrier of Hoeganaes steel core coated with polymethylmethacrylate and 20 weight percent of a conductive carbon black. A 90 minute paint shake time track was completed for this developer resulting in a toner tribo of −39.2 microcoulombs/gram after 15 minutes and dropping to −18.8 microcoulombs/gram after 90 minutes. This resulted in a degradation of toner charge of greater than 50 percent over 90 minutes of total paint shaking time, and thus this toner exhibited a significant instability, that is a decrease, in triboelectric charge.

COMPARATIVE EXAMPLE VII

The developer in Comparative Example VI was further evaluated for admix properties. This was accomplished at the end of the 90 minutes of paint shaking resulting in a unimodal charge distribution. By 15 seconds, the incumbent toner had moved toward zero charge with some wrong sign toner. The admix was completed in two minutes, and the amount of low charge (<0.2 fc/u) femtocoulombs per micron and wrong sign positively charged toner had increased to, for example, about 5 percent.

Upon breadboard machine testing in a fixture similar to the Xerox 5090, freshly blended toner from above, low quality images resulted after about 2,000 thousand copies were made. The poor images were caused by the low charge (<0.2 fc/u) and wrong sign oppositely charged toner that occured in the machine developer housing, which was simulated by the paint shake time track/admix. The low and/or less than zero q/d (toner tribo charge divided by toner diameter in microns) charge toner resulted in dirt and background on the image.

EXAMPLE VIII

A toner blend was generated as in Example VI except the RX50 was replaced with 3.2 weight percent of a 30 nanometer primary particle size and about 300 nanometer aggregate size silica core (L90) coated with a feed of 15 weight percent decyltrimethoxysilane and available from Cab-O-Sil division of Cabot Corp. A developer was then prepared by mixing 4 parts of the above blended toner with 100 parts of a carrier of Hoeganaes steel core coated with 80 weight percent polymethylmethacrylate and 20 weight percent of a Vulcan conductive carbon black. A 90 minute paint shake time track was completed for this developer resulting in a tribo of −34.6 microcoulombs/gram after 15 minutes and which tribo was −35.4 microcoulombs/gram after 90 minutes. There resulted no charge degradation over time and excellent charge stability compared to the toner in Example VI.

EXAMPLE IX

The developer in Example VIII was further evaluated for admix properties. This was accomplished at the end of the 90 minutes of paint shaking resulting in a unimodal charge distribution at 15 seconds, with no low charge or wrong sign toner with a q/d (fc/u) near zero or less than zero. Throughout 2 minutes of additional paint shaking, the toner remains highly charged with no low charge (<0.2 fc/u) or wrong sign oppositely charged toner.

Upon breadboard machine testing with freshly blended toner from above, excellent quality images resulted with excellent image density and low and less than 1 percent acceptable background.

EXAMPLE X

A toner blend was prepared as in Example V except that 3.5 is weight percent of a 30 nanometer primary particle size and about 300 nanometer aggregate size silica core (L90) coated with a feed of 15 weight percent decyltrimethoxysilane available from Cab-O-Sil division of Cabot Corp., and 2.5 weight percent SMT5103 (30 nanometers of primary particle size titanium dioxide coated with a feed of decyltrimethoxysilane from Tayca Corp.) was used. Two identical developers were prepared by mixing 4 parts of the blended toner with 100 parts of a carrier of Hoeganaes steel core coated with polymethylmethacrylate. These developers were equilibrated in a Relative Humidity chamber. One developer was equilibrated at 80 percent RH/80° F. and the other at 20 percent RH/60° F. overnight. Roll mill time tracks were accomplished for both developers resulting in average tribos over 30 minutes of mixing time of −35 microcoulombs/gram at 20 percent RH and −20 microcoulombs/gram at 80 percent RH. This resulted in a dry:wet zone (20 percent:80 percent) ratio of 1.75. The toner exhibited excellent environmental charge stability for the trimethoxydecylsilane treated silica developer.

Other modifications of the present invention may occur to one of ordinary skill in the art subsequent to a review of the present application, and these modifications, including equivalents thereof, are intended to be included within the scope of the present invention.

What is claimed is:

1. A toner comprised of binder, colorant, and a silica containing a coating of an alkylsilane.

2. A toner in accordance with claim 1 wherein said alkylsilane is an alkylsilane polymer present in an amount from about 3 to about 10 weight percent, and wherein said coated silica possesses a primary particle size of from about 25 to about 55 nanometers, and an aggregate size of from about 225 to about 400 nanometers.

3. A toner in accordance with claim 2 wherein said amount is from about 6 to about 8 weight percent.

4. A toner in accordance with claim 2 wherein said alkyl of said silane contains from about 1 to about 25 carbon atoms, and said silica is silicon dioxide.

5. A toner in accordance with claim 1 wherein said silane is decylsilane.

6. A toner in accordance with claim 2 wherein said silane is decylsilane.

7. A toner in accordance with claim 2 wherein the amount of said coated alkylsilane is determined from the feed rate or feed amount thereof of an alkylalkoxysilane, and which amount is from about 5 to about 25 weight percent.

8. A toner in accordance with claim 7 wherein said feed amount is from about 5 to about 15 weight percent.

9. A toner in accordance with claim 2 further including metal salts of fatty acids.

10. A toner in accordance with claim 9 wherein said salt is zinc stearate.

11. A toner in accordance with claim 2 further including a wax.

12. A toner in accordance with claim 2 wherein the resin is polyester.

13. A toner in accordance with claim 12 wherein the resin is a polyester formed by condensation of propoxylated bisphenol A and fumaric acid.

14. A toner in accordance with claim 2 wherein the resin is a mixture of a polyester formed by the condensation of propoxylated bisphenol A and fumaric acid, and a gelled polyester formed by condensation of propoxylated bisphenol A and fumaric acid.

15. A toner in accordance with claim 2 wherein the colorant is carbon black, cyan, magenta, yellow, red, orange, green, or violet.

16. A toner in accordance with claim 1 wherein the silica is coated with a polyalkylsilane wherein said alkyl contains from about 4 to about 18 carbon atoms.

17. A toner in accordance with claim 1 wherein said alkyl is butyl, hexyl, octyl, decyl, dodecyl, or stearyl.

18. A toner in accordance with claim 1 wherein the alkylsilane is of the formula

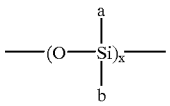

wherein a represents the repeating segment of

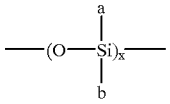

optionally enabling a crosslinked formula or structure; said repeat segment and hydroxy or hydroxy groups; said repeat segment and alkoxy or alkoxy groups; or said repeat segment and hydroxy and alkoxy groups; b is alkyl and x is a number of from 1 to about 1,000.

19. A toner in accordance with claim 2 further containing a titanium oxide optionally coated with an alkylsilane.

20. A toner in accordance with claim 19 wherein alkyl is butyl, hexyl, octyl, decyl, dodecyl, or stearyl.

21. A toner in accordance with claim 19 wherein the oxide is coated with a decylsilane.

22. A toner in accordance with claim 2 wherein the silica is coated with an input feed mixture containing about 10 to about 15 percent by weight of an alkyltrialkoxysilane.

23. A toner in accordance with claim 1 wherein the coated silica has a primary particle size of about 25 nanometers to about 55 nanometers, or wherein the coated silica has a primary particle size of about 30 nanometers to about 40 nanometers.

24. A toner in accordance with claim 1 wherein the coated silica has an aggregate size of about 225 nanometers to about 400 nanometers, or has an aggregate size of about 300 nanometers to about 375 nanometers.

25. A toner in accordance with claim 19 wherein the titanium dioxide has a primary particle size of about 25 nanometers to about 55 nanometers.

26. A toner in accordance with claim 19 wherein said titania is present in an amount of from about 1 weight percent to about 4.5 weight percent, or is present in an amount of from about 1.5 weight percent to about 3.5 weight percent.

27. A toner in accordance with claim 1 wherein said coated silica is present in an amount of from about 1 weight percent to about 6 weight percent.

28. A toner in accordance with claim 1 wherein said coated silica is present in an amount of from about 2.75 weight percent to about 4.75 weight percent.

29. A toner in accordance with claim 2 possessing a triboelectric charge of from about 15 to about 55 microcoulombs per gram, or a triboelectric charge of from about 25 to about 40 microcoulombs per gram.

30. A toner in accordance with claim 2 wherein the resin is present in an amount of from about 85 weight percent to about 99 weight percent and the colorant is present in an amount of from about 15 weight percent to about 1 weight percent.

31. A toner composition in accordance with claim 2 with an admix of from about 1 second to about 60 seconds.

32. A developer comprised of the toner of claim 1 and carrier.

33. A developer comprised of the toner of claim 2 and carrier.

34. A developer in accordance with claim 32 with an unimodal charge distribution as measured by a charge spectrograph.

35. A developer in accordance with claim 32 having an unimodal charge distribution and none or very little low charge or wrong sign toner as measured by a charge spectrograph.

36. A process for the preparation of toner comprising the mixing of resin, colorant and silica containing a coating of an alkylsilane.

37. A process in accordance with claim 36 wherein said alkylsilane is a polyalkylsilane.

38. A toner in accordance with claim 18 wherein alkyl contains from about 4 to about 20 carbon atoms, and X is from about 25 to about 500.

39. A toner in accordance with claim 18 wherein said silicon is silica dioxide.

40. A toner in accordance with claim 1 wherein said alkyl for said alkyl silane is of the formula $C_nH_2N+1$.

41. A toner comprised of binder, colorant, and a coated alkyl silane wherein the silane is of the formula

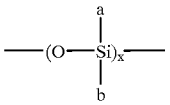

wherein a represents the repeating segment of

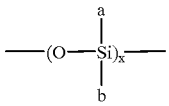

optionally enabling a crosslinked formula or structure; said repeat segment and hydroxy or hydroxy groups; said repeat segment and alkoxy or alkoxy groups; or said repeat segment and hydroxy and alkoxy groups; b is alkyl and x is a number of from 1 to about 1,000.

42. A toner comprised of binder, colorant, and a silica containing a coating of an alkylsilane, and a metal oxide.

43. A toner in accordance with claim 42 wherein said metal oxide is coated with an alkyl silane.

44. A toner in accordance with claim 43 wherein said metal oxide is titanium oxide.

45. A toner comprised of a binder colorant and a silica containing a desosilane coating.

46. A toner consisting essentially of binder, colorant, and a silica containing a coating of an alkylsilane.

47. A toner consisting of binder, colorant, and a silica containing a coating of an alkylsilane.

* * * * *